US011715887B2

(12) United States Patent
Huang et al.

(10) Patent No.: US 11,715,887 B2
(45) Date of Patent: Aug. 1, 2023

(54) ANTENNA ARRAY DEVICE AND ANTENNA UNIT THEREOF

(71) Applicant: WISTRON NEWEB CORPORATION, Hsinchu (TW)

(72) Inventors: Tsun-Che Huang, Hsinchu (TW); Huang-Tse Peng, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 12 days.

(21) Appl. No.: 17/503,419

(22) Filed: Oct. 18, 2021

(65) Prior Publication Data

US 2022/0239013 A1 Jul. 28, 2022

Related U.S. Application Data

(60) Provisional application No. 63/142,519, filed on Jan. 28, 2021.

(51) Int. Cl.
*H01Q 21/06* (2006.01)
*H01Q 1/38* (2006.01)

(52) U.S. Cl.
CPC ..... *H01Q 21/065* (2013.01); *H01Q 1/38* (2013.01)

(58) Field of Classification Search
CPC ..... H01Q 21/065; H01Q 1/38; H01Q 1/288; H01Q 9/0414; H01Q 21/0031
See application file for complete search history.

(56) References Cited

U.S. PATENT DOCUMENTS

2013/0335292 A1* 12/2013 Hung ..... H01Q 9/42 343/866
2021/0328335 A1* 10/2021 Kosaka ..... H01Q 1/02
2022/0140475 A1* 5/2022 Schober ..... H05K 1/0204 343/702
2022/0376405 A1* 11/2022 Chen ..... H01Q 1/1207

* cited by examiner

*Primary Examiner* — David E Lotter
(74) *Attorney, Agent, or Firm* — McClure, Qualey & Rodack, LLP

(57) ABSTRACT

An antenna array device and an antenna unit thereof are provided. The antenna unit includes a support and an antenna structure. The support is integrally formed as a single one-piece structure, and has a substrate, a first stand, and a second stand. The first stand and the second stand extend from two opposite sides of the substrate, respectively. The substrate and at least one of the first stand and the second stand jointly define a plurality of cavities. The antenna structure includes a plurality of patches that are formed on the substrate and that are arranged in the cavities.

17 Claims, 15 Drawing Sheets

ANTENNA ARRAY DEVICE AND ANTENNA UNIT THEREOF

CROSS-REFERENCE TO RELATED PATENT APPLICATION

This application claims priority to the U.S. Provisional Patent Application Ser. No. 63/142,519 filed on Jan. 28, 2021, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna, and more particularly to an antenna array device and an antenna unit thereof.

BACKGROUND OF THE DISCLOSURE

A conventional antenna device includes a plurality of antenna units and a plurality of spacers that are provided to separate the antenna units from each other. In other words, any two of the antenna units adjacent to each other are separated from each other by one of the spacers. However, since each of the antenna units of the conventional antenna device needs to be assembled with at least one of the spacers, a production process of the conventional antenna device is prolonged, and an issue of tolerance accumulation easily occurs in the assembling of the antenna units and the spacers.

SUMMARY OF THE DISCLOSURE

In response to the above-referenced technical inadequacies, the present disclosure provides an antenna array device and an antenna unit thereof, so as to effectively improve on the issues associated with conventional antenna devices.

In one aspect, the present disclosure provides an antenna array device, which includes a first housing, a second housing, and an antenna module. The first housing and the second housing are connected to each other so as to jointly define a distribution space. The antenna module is located in the distribution space, and includes a first antenna unit and a second antenna unit. The first antenna unit includes a support and a first antenna structure. The support is integrally formed as a single one-piece structure, and the support has a first substrate, a first stand, and a second stand. The first stand and the second stand extend from two opposite sides of the first substrate, respectively, and the first stand faces toward the first housing. The first substrate and at least one of the first stand and the second stand jointly define a plurality of cavities. The first antenna structure includes a plurality of first patches that are formed on the first substrate and that are arranged in the cavities. The second antenna unit is connected to the second stand of the support.

In another aspect, the present disclosure provides an antenna unit of an antenna array device. The antenna unit includes a support and an antenna structure. The support is integrally formed as a single one-piece structure, and has a substrate, a first stand, and a second stand. The first stand and the second stand extend from two opposite sides of the substrate, respectively. The substrate and at least one of the first stand and the second stand jointly define a plurality of cavities. The antenna structure includes a plurality of patches that are formed on the substrate and that are arranged in the cavities.

Therefore, the antenna unit (e.g., the first antenna unit) of the present disclosure is provided with the support that is integrally formed as a single one-piece structure having the cavities, so that the first patches can be formed on the support and arranged in the cavities, thereby reducing a quantity of components to be assembled in the antenna array device. Accordingly, a production process of the antenna array device can be shortened, and tolerance accumulation generated from assembling the components of the antenna array device can be effectively reduced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
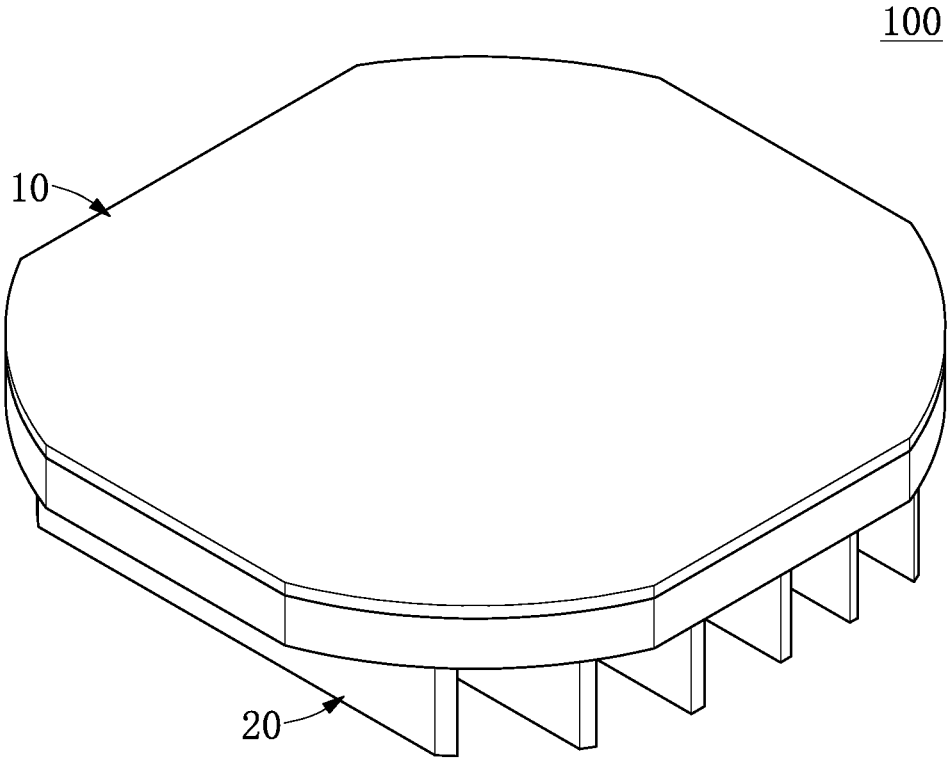
FIG. 1 is a perspective view of an antenna array device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

In addition, the term "connect" used herein refers to a physical connection between two elements, which can be a direct connection or an indirect connection. Moreover, the term "couple to" or "coupling to" used herein refers to two elements being separated and having no physical connection, and an electric field generated by a current of one of the two elements excites that of the other one.

Figure 2:
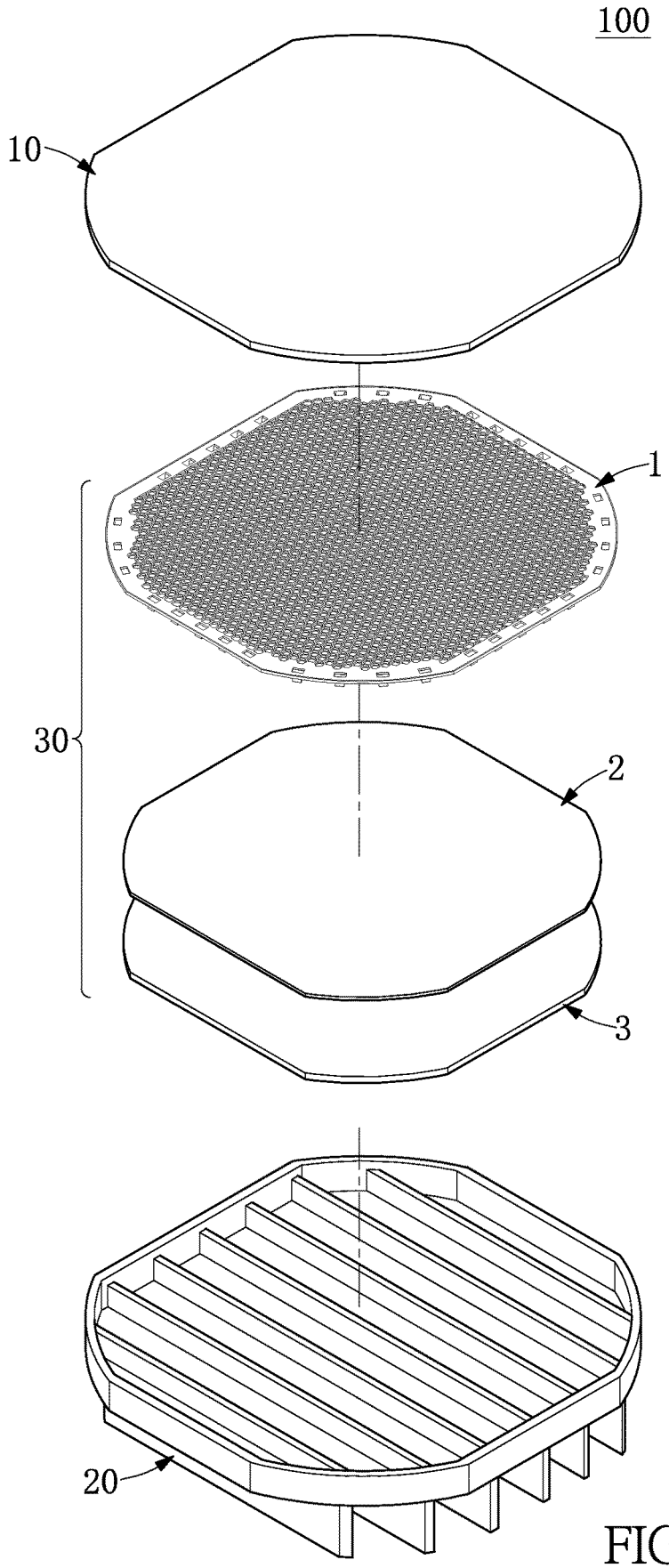
FIG. 2 is an exploded view of FIG. 1.
Figure 3:
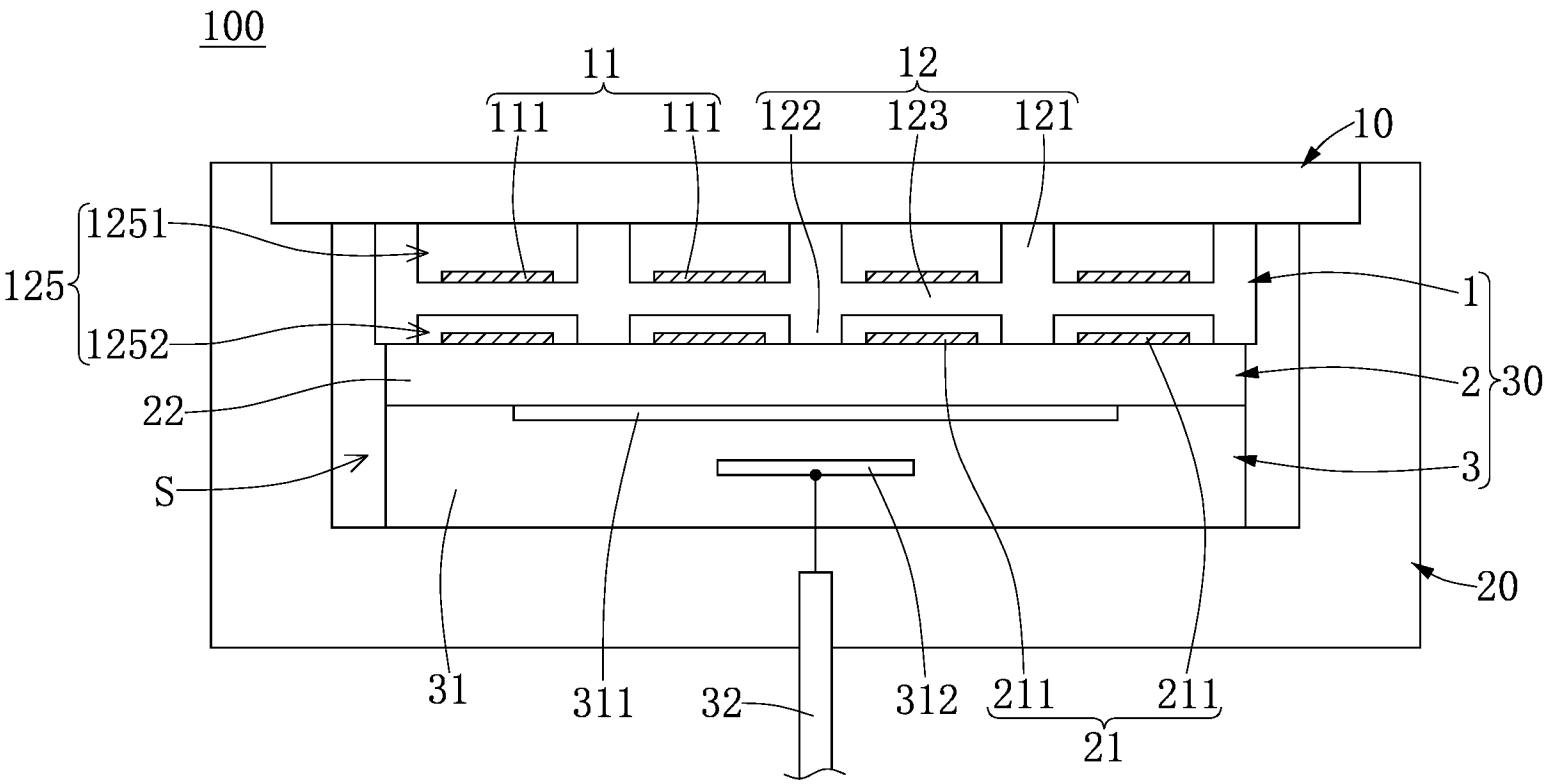
FIG. 3 is a schematic cross-sectional view of FIG. 1.

Referring to FIG. 1 to FIG. 14, an embodiment of the present disclosure provides an antenna array device 100. As shown in FIG. 1 to FIG. 3, the antenna array device 100 in the present embodiment can be a satellite antenna device that is used to emit and receive signals to and from a satellite, but the present disclosure is not limited thereto. The antenna array device 100 includes a first housing 10, a second housing 20, and an antenna module 30 that is located between the first housing 10 and the second housing 20.

The first housing 10 and the second housing 20 are connected to each other so as to jointly define a distribution space S, and the antenna module 30 is located in the distribution space S. The distribution space S is a substantially enclosed space, and at least one of the first housing 10 and the second housing 20 preferably has a structure arranged in the distribution space S for holding the antenna module 30. However, the specific structure of any one of the first housing 10 and the second housing 20 can be adjusted or changed according to design requirements, and is not limited by the present embodiment.

The antenna module 30 includes a first antenna unit 1, a second antenna unit 2, and a feeding antenna unit 3. The feeding antenna unit 3, the second antenna unit 2, and the first antenna unit 1 in the present embodiment are sequentially stacked on the second housing 20. In other words, the first antenna unit 1 is arranged adjacent to the first housing 10, the feeding antenna unit 3 is disposed on the second housing 20, and the second antenna unit 2 is sandwiched between the first antenna unit 1 and the feeding antenna unit 3.

It should be noted that the first antenna unit 1 in the present embodiment is in cooperation with the second antenna unit 2, the feeding antenna unit 3, the first housing 10, and the second housing 20, but the present disclosure is not limited thereto. For example, in other embodiments of the present disclosure (not shown in the drawings), the first antenna unit 1 can be independently used (e.g., sold) or can be used in cooperation with other components. The following description describes the structure and connection relationship of each component of the antenna module 30.

Figure 4:
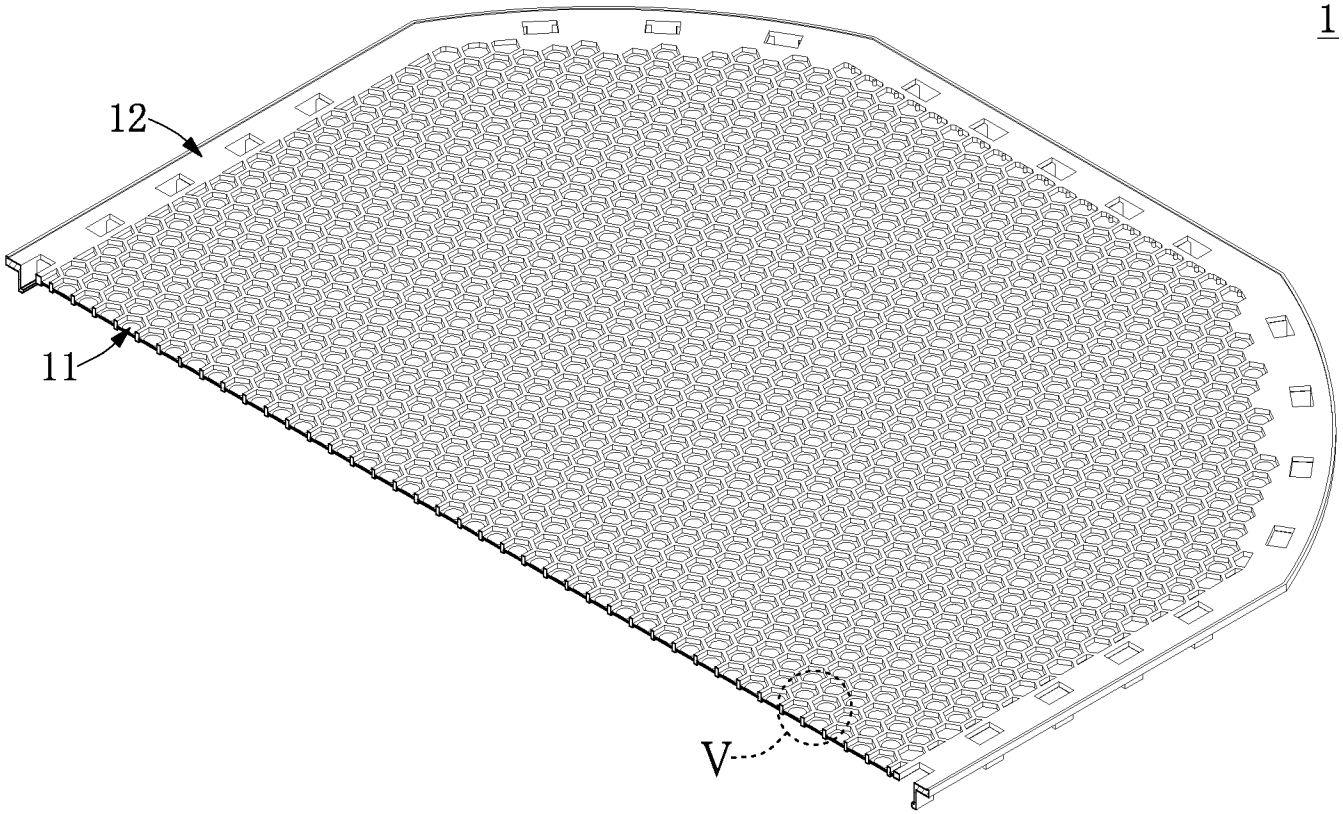
FIG. 4 is a perspective cross-sectional view showing a first antenna unit (or an antenna unit) of FIG. 2.
Figure 5:
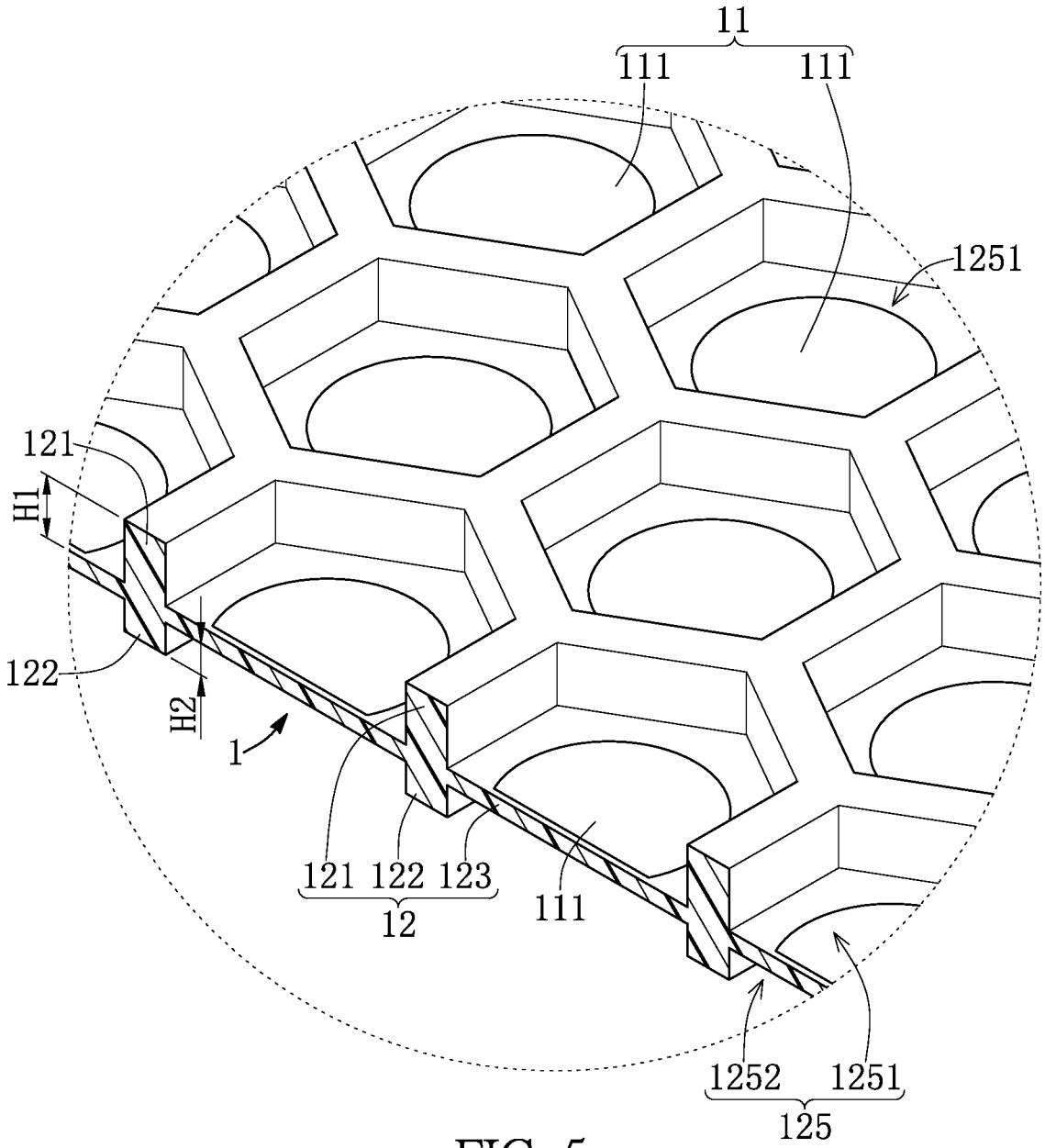
FIG. 5 shows an enlarged view of part V of FIG. 4.

As shown in FIG. 4 and FIG. 5, the first antenna unit 1 includes a support 12 and a first antenna structure 11 that is formed on the support 12. In other words, the first antenna structure 11 and the support 12 in the present embodiment cannot be separate from each other.

The support 12 is integrally formed as a single one-piece structure. The support 12 has a first substrate 123, a first stand 121, and a second stand 122. Moreover, the first stand 121 and the second stand 122 extend from two opposite sides of the first substrate 123 (e.g., the upper surface and the lower surface of the first substrate 123 shown in FIG. 4), respectively. It should be noted that the antenna module 30 in the present embodiment excludes any multi-piece support (e.g., a riveting support or an engaging support) different from the support 12, so that the antenna module 30 can be assembled with high precision.

Specifically, the first substrate 123 and at least one of the first stand 121 and the second stand 122 jointly define a plurality of cavities 125. In the present embodiments, the cavities 125 include a plurality of first cavities 1251 that are defined by the first substrate 123 and the first stand 121 and a plurality of second cavities 1252 that are defined by the first substrate 123 and the second stand 122.

The first antenna structure 11 includes a plurality of first patches 111 that are formed on the first substrate 123 and that are arranged in the cavities 125. The first patches 111 in the present embodiment are formed on an upper surface of the first substrate 123 and are arranged in the first cavities 1251, and each of the first patches 111 is substantially in a circular shape, but the present disclosure is not limited thereto. For example, in other embodiments of the present disclosure (not shown in the drawings), the first patches 111 can be formed on the upper surface and/or a lower surface of the first substrate 123 (i.e., the first patches 111 can be arranged in the first cavities 1251 and/or the second cavities 1252), and the shape of the first patch 111 can be adjusted or changed according to design requirements.

Specifically, the first patches 111 of the present embodiment are plated on the first substrate 123 in a laser direct structuring (LDS) manner or a laser circuit technology (LCT) manner. Moreover, the support 12 can be made of polycarbonate (PC) and/or acrylonitrile butadiene styrene (ABS), and the first patches 111 can be made of copper or a combination of copper and nickel gold.

Figure 6:
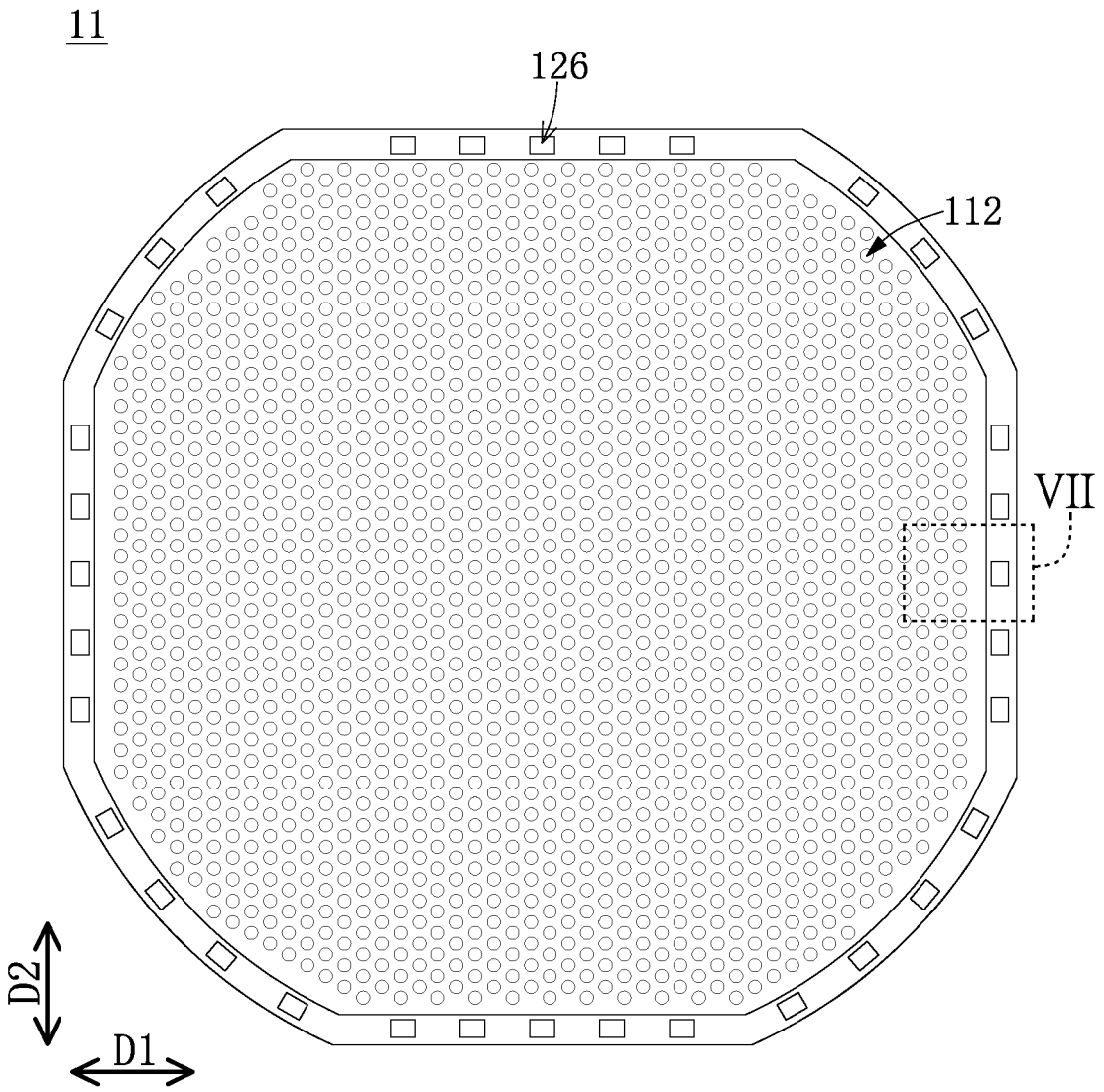
FIG. 6 is a top view of a first antenna structure (or an antenna structure) according to the first embodiment of the present disclosure.
Figure 7:
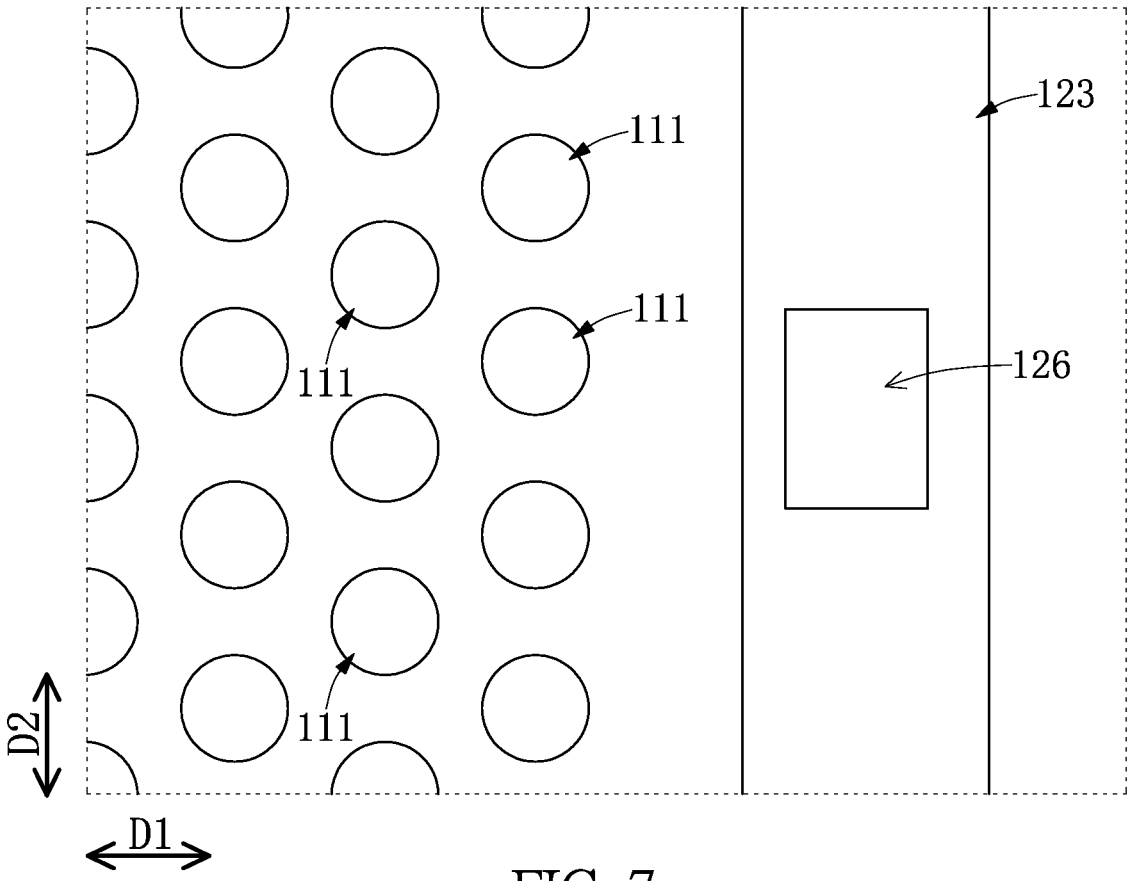
FIG. 7 shows an enlarged view of part VIIA of FIG. 6.

In addition, as shown in FIG. 6 and FIG. 7, the first patches 111 are arranged in a plurality of rows each parallel to a first direction D1, and the first patches 111 are also arranged in a plurality of columns each parallel to a second direction D2. The second direction D2 is perpendicular to the first direction D1. In the present embodiment, any two of the rows of the first patches 111 are not overlapped with each other along the second direction D2, and any two of the columns of the first patches 111 are partially overlapped with each other along the first direction D1, but the present disclosure is not limited thereto. For example, in other embodiments of the present disclosure (not shown in the drawings), any two of the columns of the first patches 111 can be not overlapped with each other along the first direction D1.

Figure 8:
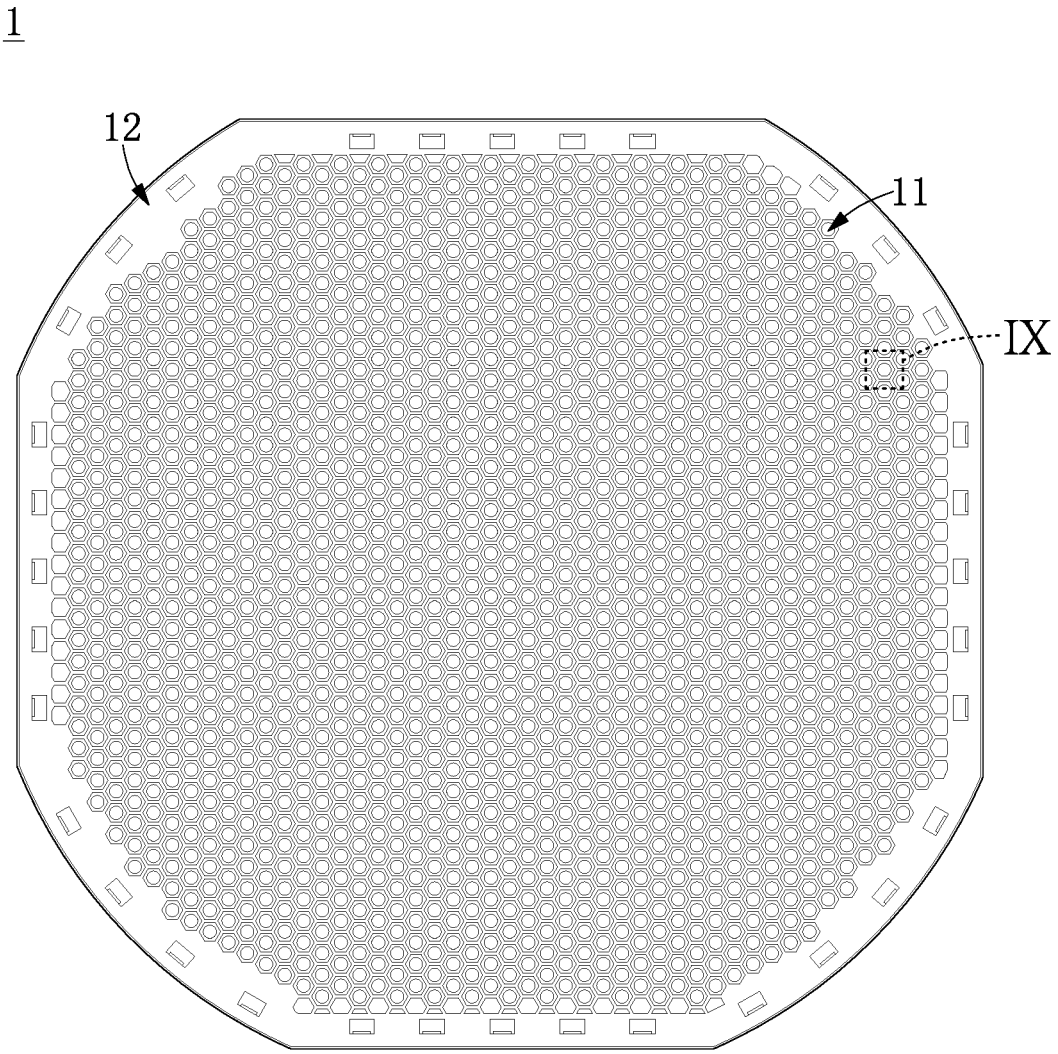
FIG. 8 is a top view showing the first antenna unit (or the antenna unit) of FIG. 2.
Figure 9:
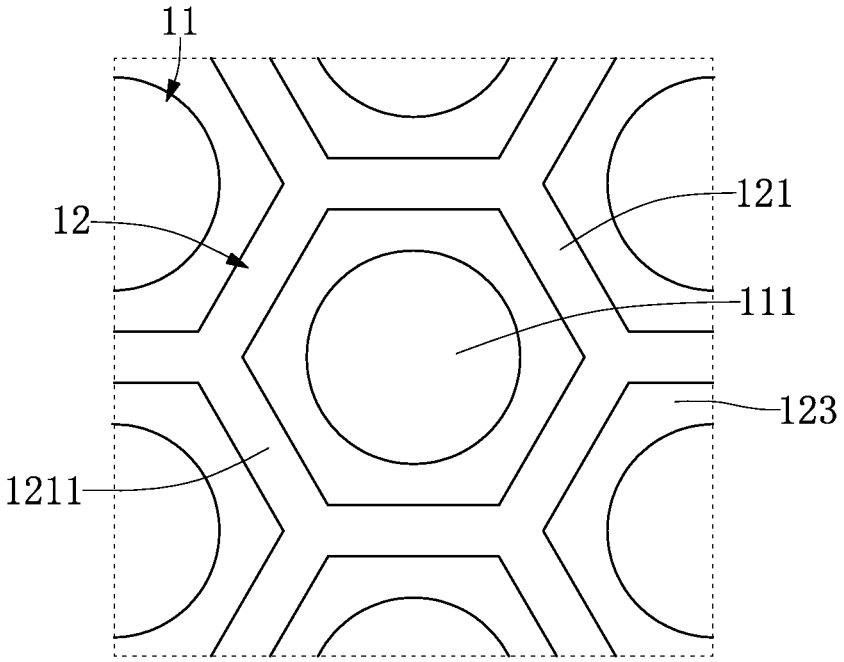
FIG. 9 shows an enlarged view of part IX of FIG. 8.

As shown in FIG. 4 and FIG. 5, the first stand 121 is formed on the upper surface of the first substrate 123 by a predetermined pattern. Moreover, as shown in FIG. 8 and FIG. 9, the first stand 121 includes a plurality of first partitions 1211 connected to each other. The first partitions 1211 integrally extend from the upper surface of the first substrate 123, and surround the first patches 111. In the present embodiment, a quantity of the first patches 111 surrounded by any one of the first partitions 1211 is less than or equal to four.

Specifically, each of the first partitions 1211 has a shape of a regular polygon having N number of sides, and N is a positive integer greater than three. Any two of the first partitions 1211 connected to each other share one side. In other words, one of the first partitions 1211 is at most connected to N number of the first partitions 1211. In the present embodiment, N is six, and a quantity of the first patches 111 surrounded by any one of the first partitions 1211 is one, but the present disclosure is not limited thereto. For example, in other embodiments of the present disclosure (not shown in the drawings), the shape of the first partition 1211 can be different from the regular polygon shape (e.g., can be a circular shape).

The second stand 122 includes a plurality of second partitions 1221 connected to each other. The second partitions 1221 integrally extend from the lower surface of the first substrate 123. In the present embodiment, a projection region defined by orthogonally projecting the second partitions 1221 onto the first stand 121 overlaps with the first partitions 1211.

In other words, a contour (or a cross section) of the first stand 121 in the present embodiment is substantially identical to a contour (or a cross section) of the second stand 122, so that the first stand 121 and the second stand 122 can have a better supporting effect along a direction perpendicular to the first substrate 123, thereby preventing the first antenna structure 11 from being damaged.

In addition, any one of the first partitions 1211 has a first height H1 relative to the first substrate 123 (e.g., the upper surface), any one of the second partitions 1221 has a second height H2 relative to the first substrate 123 (e.g., the lower surface), and the second height H2 is less than the first height H1.

According to the above, the first antenna unit 1 in the present embodiment is provided with the support 12 that is integrally formed as a single one-piece structure having the cavities 125, so that the first patches 111 can be arranged in the cavities 125, thereby reducing a quantity of components to be assembled in the antenna array device 100. Accordingly, a production process of the antenna array device 100 can be shortened, and tolerance accumulation generated from assembling the components of the antenna array device 100 can be effectively reduced.

Figure 12A:
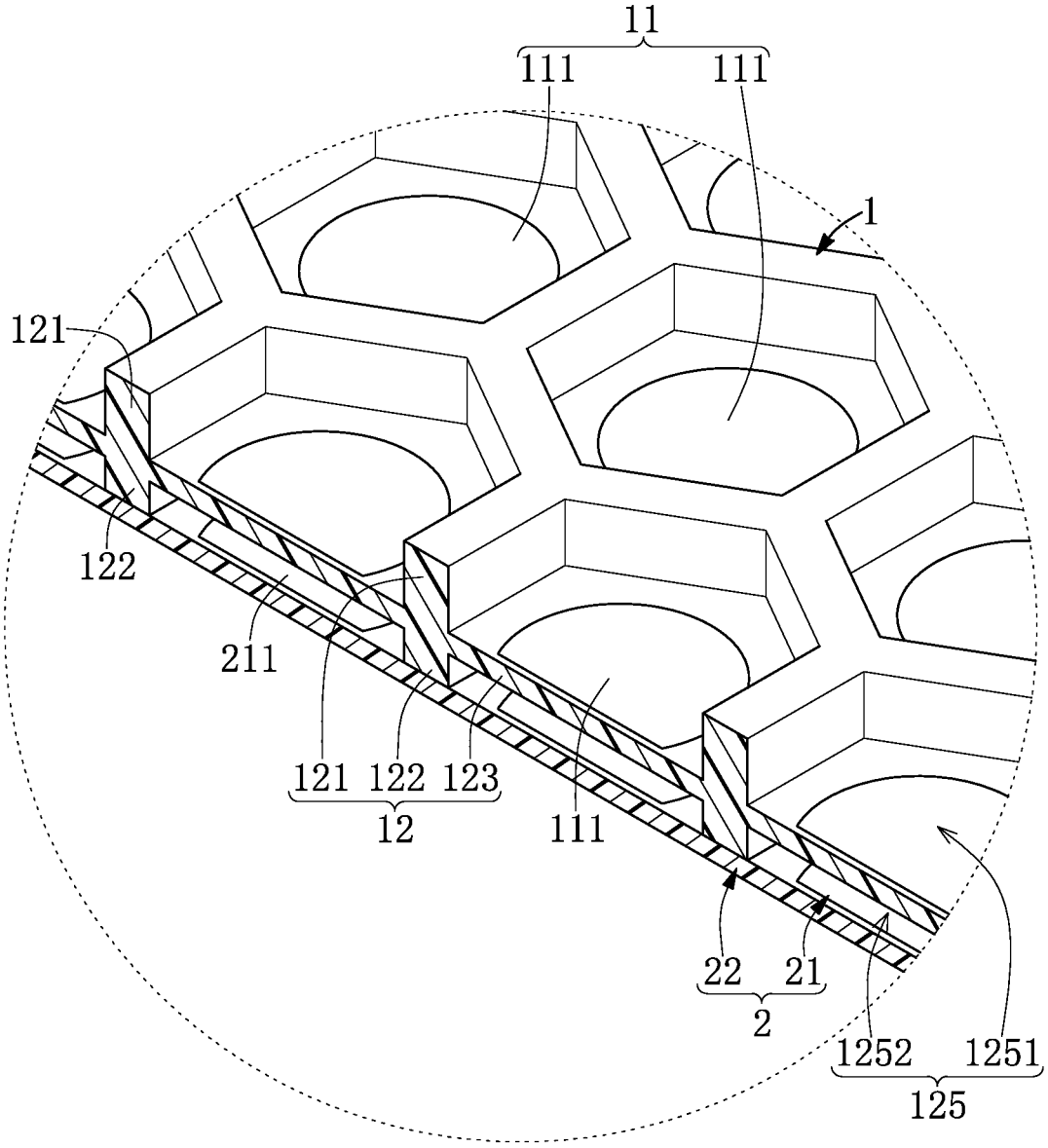
FIG. 12A is a partial cross-sectional view of the first antenna structure and a second antenna structure according to the first embodiment of the present disclosure.

As shown in FIG. 2, FIG. 3, and FIG. 12A, the second antenna unit 2 is disposed on the second stand 122 of the support 12, and includes a second substrate 22 being in a flat shape and a second antenna structure 21 that is formed on the second substrate 22. The first stand 121 faces toward the first housing 10, and the second stand 122 faces toward the substrate 22 of the second antenna unit 2. Moreover, a thickness of the second substrate 22 in the present embodiment can be within a range from 0.5 mm to 1.2 mm.

Figure 12B:
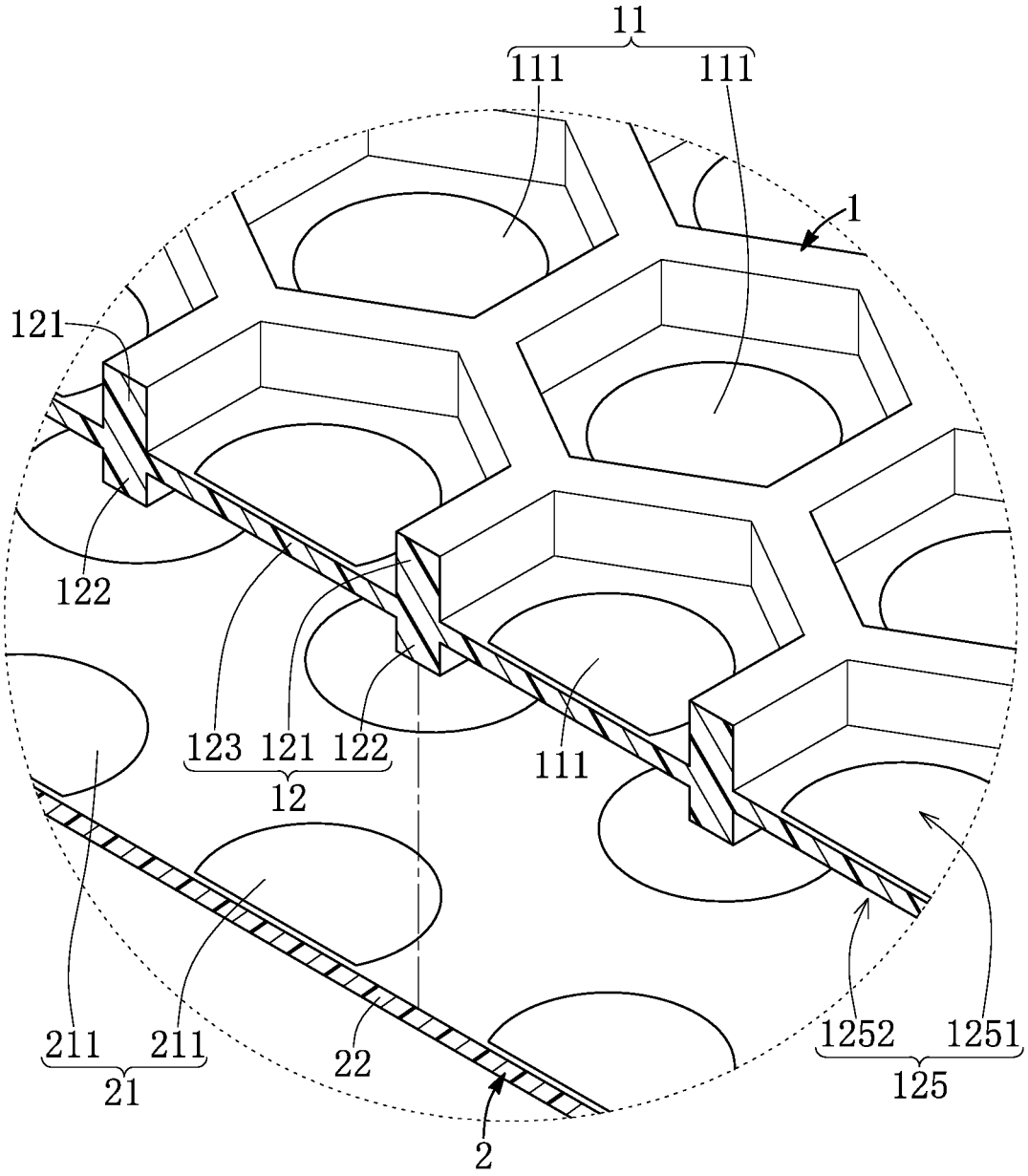
FIG. 12B is an exploded view of FIG. 12A.

As shown in FIG. 12A and FIG. 12B, the second antenna structure 21 includes a plurality of second patches 211 that are formed (e.g., plated) on the second substrate 22 and that respectively correspond in position to the first patches 111 along a height direction H. In other words, the second substrate 22 is sandwiched between the second stand 122 and the feeding antenna unit 3, and the second patches 211 are (respectively) arranged in the second cavities 1252. Accordingly, any one of the second patches 211 can couple to a corresponding one of the first patches 111.

It should be noted that the second height H2 in the present embodiment is less than the first height H1 and can be in a range from 0.5 mm to 1.2 mm, so that a distance between any one of the first patches 111 and a corresponding one of the second patches 211 can be within a range from 0.8 mm to 1.35 mm. Accordingly, the coupling performance of any one of the first patches 111 and a corresponding one of the second patches 211 can be effectively enhanced.

Figure 14:
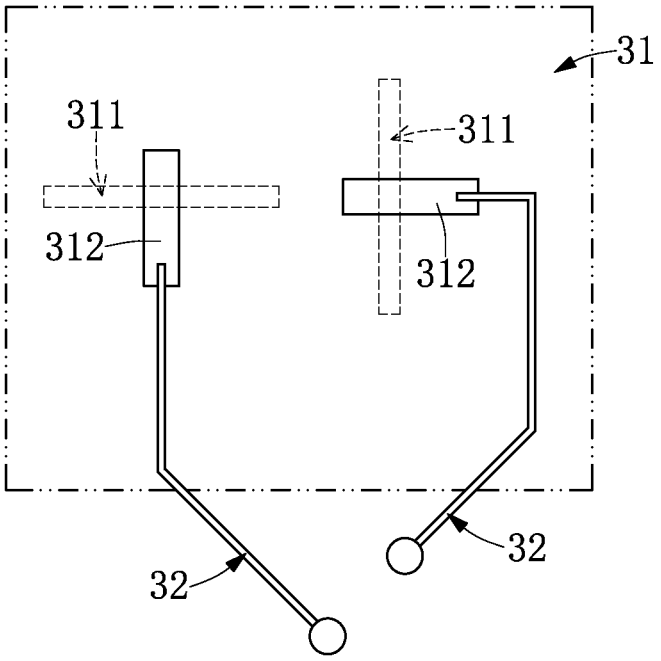
FIG. 14 is a schematic view of a feeding antenna unit according to the first embodiment of the present disclosure.

As shown in FIG. 2, FIG. 3, and FIG. 14, the feeding antenna unit 3 is located between the second housing 20 and the second antenna unit 2 (e.g., the second substrate 22), and is configured to couple to the second antenna structure 21. In the present embodiment, the feeding antenna unit 3 includes a circuit board 31 and at least one feeding cable 32 that is connected to the circuit board 31. The circuit board 31 has at least one antenna 311 having a slot (e.g., a slot antenna) and at least one radiating portion 312 that is configured to couple to the at least one antenna 311. The at least one antenna 311 is arranged adjacent to the second antenna structure 21 and is configured to couple to the second antenna structure 21. The antenna 311 is excited by the at least one radiating portion 312 which is connected to and fed by the at least one feeding cable 32 (i.e., the at least one radiating portion 312 is configured to couple to the at least one antenna 311), and the second antenna structure 21 can be further configured to couple to the first antenna structure 11. In another embodiment, the antenna 311 may be a patch which is connected to the feeding cable 32. In other embodiments of the present disclosure (not shown in the drawings), the at least one antenna 311 can be a patch.

Figure 10:
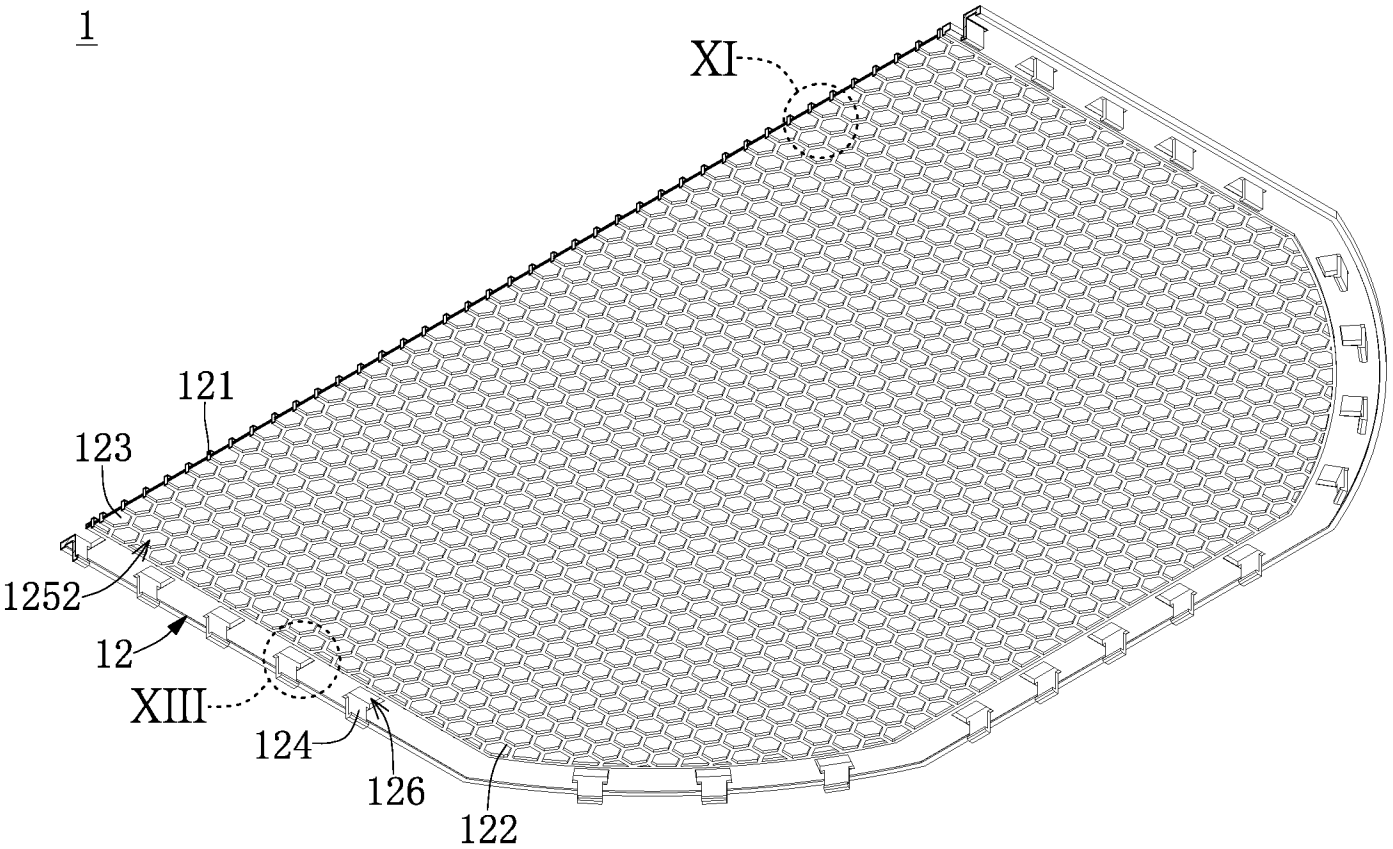
FIG. 10 is a perspective cross-sectional view showing the first antenna unit (or the antenna unit) of FIG. 2 from another angle of view.
Figure 11:
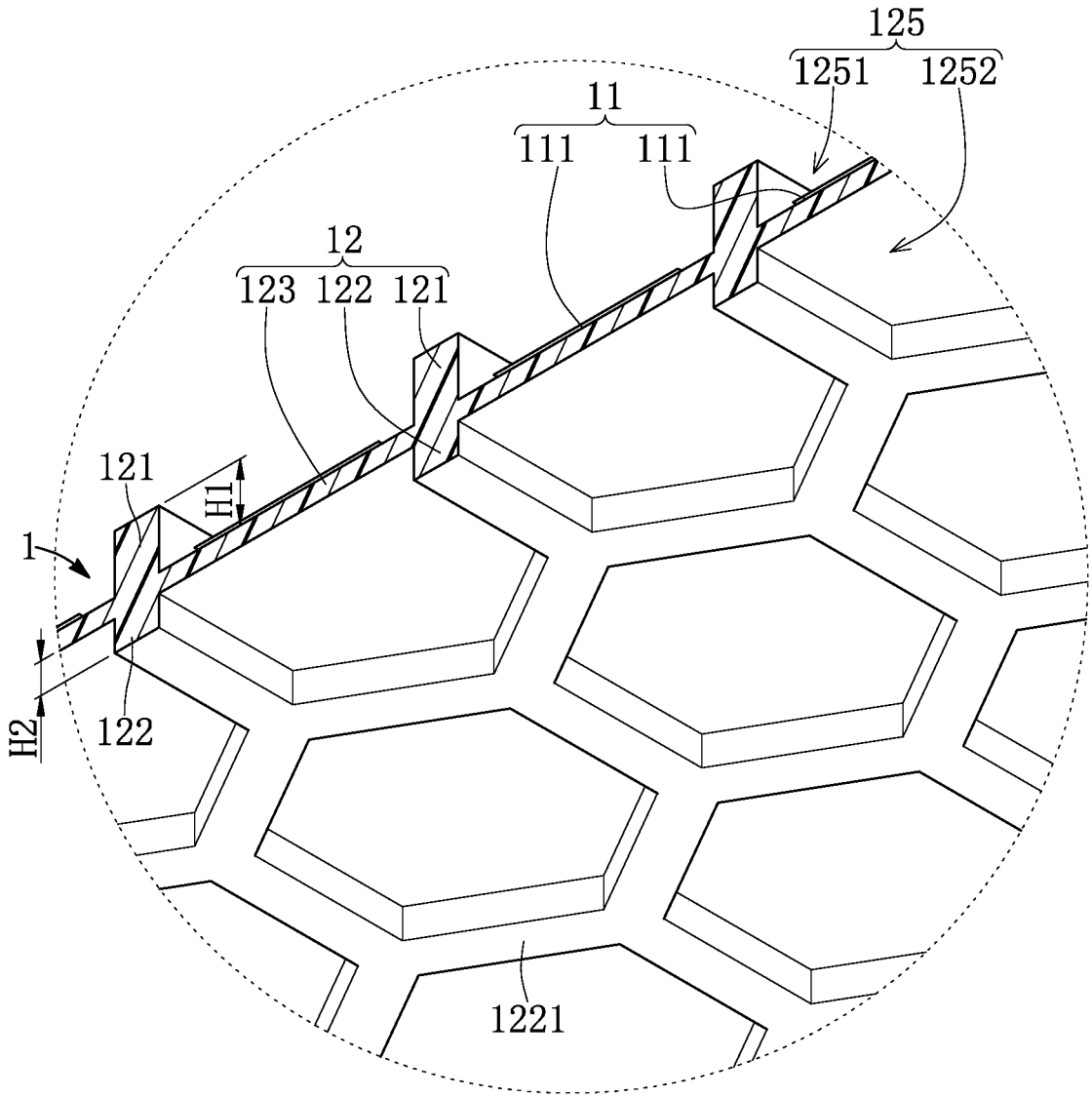
FIG. 11 shows an enlarged view of part XI of FIG. 10.
Figure 13:
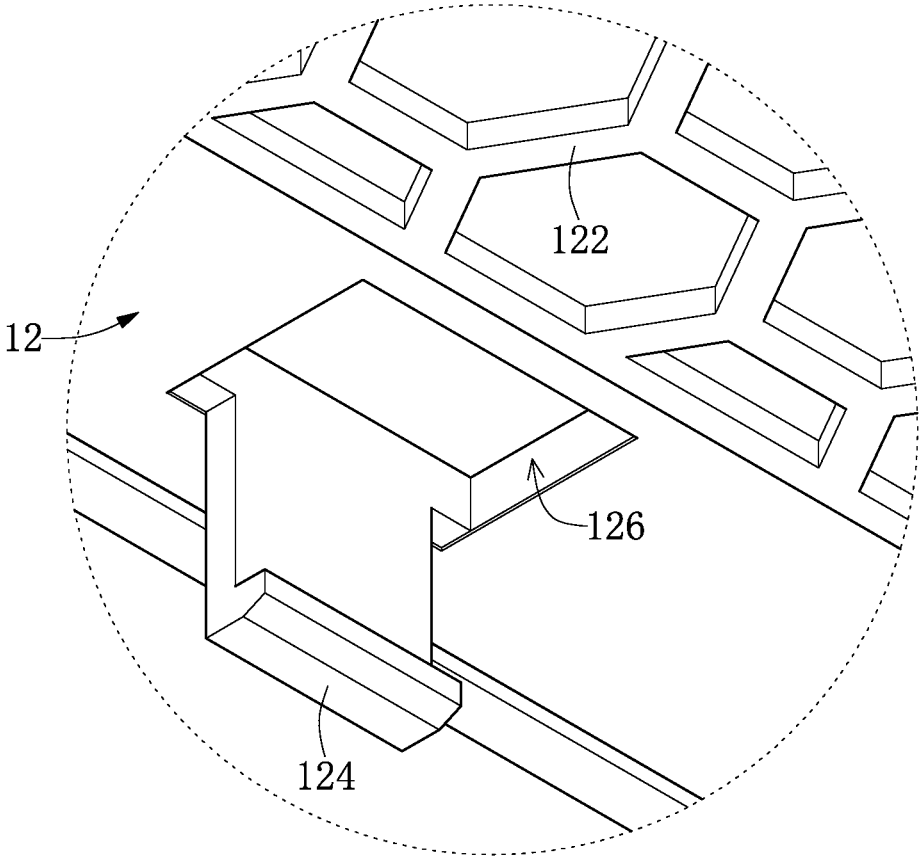
FIG. 13 shows an enlarged view of part XIII of FIG. 10.

As shown in FIG. 10 and FIG. 13, the support 12 in the present embodiment has a plurality of thru-holes 126 that are distributed outside of the first patches 111 and that are arranged along the peripheral edge of the support 12, and the support 12 includes a plurality of engaging arms 124 respectively passing through the thru-holes 126, so that the first antenna structure 11 can be assembled to other components through the thru-holes 126 and the engaging arms 124, but the present disclosure is not limited thereto. For example, in other embodiments of the present disclosure (not shown in the drawings), the support 12 can be provided without any thru-hole 126 and any engaging arm 124.

Beneficial Effects of the Embodiment

In conclusion, the antenna unit (e.g., the first antenna unit) in the present disclosure is provided with the support that is integrally formed as a single one-piece structure having the cavities, so that the first patches can be formed on the support and arranged in the cavities, thereby reducing a quantity of components to be assembled in the antenna array device. Accordingly, a production schedule of the antenna array device can be shortened, and tolerance accumulation generated from assembling the components of the antenna array device can be effectively reduced.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna array device, comprising:

a first housing and a second housing that are connected to each other so as to jointly define a distribution space; and an antenna module located in the distribution space and including:

a first antenna unit including:

a support integrally formed as a single one-piece structure, wherein the support has a first substrate, a first stand, and a second stand, wherein the first stand and the second stand extend from two opposite sides of the first substrate, respectively, and the first stand faces toward the first housing, and wherein the first substrate and at least one of the first stand and the second stand jointly define a plurality of cavities; and a first antenna structure including a plurality of first patches that are formed on the first substrate and that are arranged in the cavities; and a second antenna unit connected to the second stand of the support.

2. The antenna array device according to claim 1, wherein the first stand includes a plurality of first partitions surrounding the first patches, and wherein a quantity of the first patches surrounded by any one of the first partitions is less than or equal to four.

3. The antenna array device according to claim 1, wherein the first stand includes a plurality of first partitions surrounding the first patches, and wherein a quantity of the first patches surrounded by any one of the first partitions is one.

4. The antenna array device according to claim 3, wherein each of the first partitions has a shape of a regular polygon having N number of sides, and N is a positive integer greater than three.

5. The antenna array device according to claim 1, wherein the first stand includes a plurality of first partitions surrounding the first patches, and the second stand includes a plurality of second partitions, and wherein a projection region defined by orthogonally projecting the second partitions onto the first stand overlaps with the first partitions.

6. The antenna array device according to claim 5, wherein any one of the first partitions has a first height relative to the first substrate, any one of the second partitions has a second height relative to the first substrate, and the second height is less than the first height.

7. The antenna array device according to claim 1, wherein the first patches are arranged in a plurality of rows each parallel to a first direction and in a plurality of columns each parallel to a second direction that is perpendicular to the first direction.

8. The antenna array device according to claim 1, wherein the first patches are plated on the first substrate.

9. The antenna array device according to claim 1, wherein the antenna module includes a feeding antenna unit, and the second antenna unit is sandwiched between the second stand and the feeding antenna unit and includes a second substrate and a second antenna structure that is formed on the second substrate, wherein the feeding antenna unit includes a circuit board having at least one antenna arranged adjacent to the second antenna structure, and wherein the at least one antenna is configured to couple to the second antenna structure, and the second antenna structure is configured to couple to the first antenna structure.

10. The antenna array device according to claim 9, wherein the feeding antenna unit further includes at least one feeding cable, and the circuit board further includes at least one radiating portion that is connected to the at least one feeding cable, and wherein the at least one radiating portion is configured to couple to the at least one antenna having a slot, and the at least one antenna is configured to couple to the second antenna structure.

11. The antenna array device according to claim 1, wherein the second antenna unit includes a second substrate being in a flat shape and a plurality of second patches that are plated on the second substrate and that respectively correspond in position to the first patches.

12. The antenna array device according to claim 11, wherein the second substrate is sandwiched between the second stand and the feeding antenna unit, wherein the cavities include a plurality of first cavities that are defined by the first substrate and the first stand and a plurality of second cavities that are defined by the first substrate and the second stand, and wherein the first patches are arranged in the first cavities, and the second patches are arranged in the second cavities.

13. An antenna unit of an antenna array device, comprising:

a support integrally formed as a single one-piece structure, wherein the support has a substrate, a first stand, and a second stand, wherein the first stand and the second stand extend from two opposite sides of the substrate, respectively, and wherein the substrate and at least one of the first stand and the second stand jointly define a plurality of cavities; and an antenna structure including a plurality of patches that are formed on the substrate and that are arranged in the cavities.

14. The antenna unit according to claim 13, wherein the patches are arranged in a plurality of rows each parallel to a first direction and in a plurality of columns each parallel to a second direction that is perpendicular to the first direction.

15. The antenna unit according to claim 14, wherein the patches are plated on the substrate.

16. The antenna unit according to claim 13, wherein the first stand includes a plurality of first partitions surrounding the patches, and wherein each of the first partitions has a shape of a regular polygon having N number of sides, and N is a positive integer greater than three.

17. The antenna unit according to claim 16, wherein the second stand includes a plurality of second partitions, and wherein a projection region defined by orthogonally projecting the second partitions onto the first stand overlaps with the first partitions.

* * * * *